US007686436B2

(12) United States Patent
Jung et al.

(10) Patent No.: US 7,686,436 B2
(45) Date of Patent: Mar. 30, 2010

(54) INK RECHARGING SYSTEM FOR INK CARTRIDGE, BULK INK CARTRIDGE USED IN SAID SYSTEM, AND INK RECHARGING METHOD USING THEM

(75) Inventors: Hae-Sung Jung, Seoul (KR); Chang-Soo Yu, Suwon-si (KR); Kwang-Choon Chung, Yongin (KR); In-Ha Kim, Gunpo-si (KR); Ki-Hun Kang, Sungnam-si (KR); Hyung-Ho Gil, Siheung-si (KR)

(73) Assignee: Inktec Co., Ltd. (KR)

( * ) Notice: Subject to any disclaimer, the term of this patent is extended or adjusted under 35 U.S.C. 154(b) by 852 days.

(21) Appl. No.: 11/485,018

(22) Filed: Jul. 12, 2006

(65) Prior Publication Data

US 2008/0291249 A1 Nov. 27, 2008

(30) Foreign Application Priority Data

Oct. 20, 2005 (KR) ..... 10-2005-0099397

(51) Int. Cl.
*B41J 2/175* (2006.01)

(52) U.S. Cl. ..... 347/85

(58) Field of Classification Search ..... 347/5, 347/7, 84, 85; 141/2, 18
See application file for complete search history.

(56) References Cited

U.S. PATENT DOCUMENTS 6,729,360 B2 * 5/2004 Sesek et al. ..... 141/2
7,089,973 B2 * 8/2006 Nicodem et al. ..... 141/18
7,207,667 B2 * 4/2007 Ansier et al. ..... 347/85
7,344,215 B2 * 3/2008 Cutler et al. ..... 347/7

FOREIGN PATENT DOCUMENTS

KR 2003-0069596 8/2003

* cited by examiner

*Primary Examiner*—Anh T. N. Vo
(74) *Attorney, Agent, or Firm*—Cantor Colburn LLP

(57) ABSTRACT

The present invention relates to an ink recharging system in which the ink can be recharged into a used ink cartridge repeatedly, a bulk ink cartridge used in the system, and a method for recharging the ink into the ink cartridge using them. The ink recharging system for the ink cartridge installed in an inkjet printer comprises a compressor and a positive pressure tank for providing the compression force to supply the ink stored in the quantitative ink supply cylinder to the ink cartridge, a charging cylinder for applying the compression force and the suction force to the quantitative ink supply cylinder, automatic quantitative position control means for measuring the movement displacement of the charging cylinder, a vacuum pump and a negative pressure tank for producing a vacuum in the ink cartridge, and a compressed air supply tube diverged and connected to the inlet and outlet of the charging cylinder from the positive pressure tank via the solenoid valve for air pressure. The present invention provides a recharging system for the ink cartridge and a method for recharging the ink cartridge, in which the remaining air or ink in the recycled ink cartridge can be easily discharged and vacuum degree of the ink cartridge can be precisely controlled by the control means for the quantitative position, to thereby charge the quantitative ink into the recycled ink cartridge rapidly and accurately, and relates to a bulk ink cartridge which can prevent wrong installment with simple identifying members.

21 Claims, 8 Drawing Sheets

(a)

(b)

(a)

(b)

(c)

(d)

INK RECHARGING SYSTEM FOR INK CARTRIDGE, BULK INK CARTRIDGE USED IN SAID SYSTEM, AND INK RECHARGING METHOD USING THEM

BACKGROUND OF THE INVENTION

1. Field of the Invention

The present invention relates to an ink recharging system in which the ink can be recharged into a recycled ink cartridge repeatedly, a bulk ink cartridge used in the system, and a method for recharging the ink into the ink cartridge using them.

2. Background of the Related Art

As generally known in the art, the cost of the ink cartridges, which are expendables, is relatively high in comparison with the cost of the main body of the inkjet printer, and recently it becomes general to recycle the used ink cartridges in view of the protection for the environment. As for the recycling method of the ink cartridges, the consumers can purchase the ink for themselves and recharge the ink into the used ink cartridge by using simple tools, or a replaceable ink cartridge, which is fabricated to be identical with the ink cartridge which was installed to the main body of the inkjet printer at the time of purchasing the product, or an rechargeable ink cartridge coinciding with the type of the inkjet printer can be purchased and recharged repeatedly.

As one of the conventional art of recharging method of the ink into the used ink cartridge, in Korean patent Application Laid Open No. 10-2003-69596, there is disclosed an ink cartridge recharging system, in which special marketers can provide the consumers with an ink recharging service. This system is constructed that the used ink cartridge can be recharged by simple operation of a switch after it has been installed to a cartridge installing device. Further, there have been known a number of methods for injecting a black ink by means of a nozzle with single injection opening structure, however, in case of a color ink cartridge, the ink is supplied into the cartridge with a separate needle (thin injection needle structure) through a separate hole for recharging, and it has not been generally adapted to inject the color ink through the nozzle with a plurality of injection openings structure according to their colors.

Next, referring to FIGS. 1 to 3, the conventional recharging system 100 for the ink cartridge disclosed in the above Korean Patent Application Laid Open gazette will be described briefly.

FIG. 1 shows schematically the conventional ink recharging system for the ink cartridge. The ink cartridge recharging system 100 comprises a cartridge installing device 110, a reservoir 120 for temporarily storing the ink to supply the ink through the tube 101 for injecting the ink into the ink cartridge, an ink tank 140 for supplying the ink into the reservoir 120 through the tube 102 for supplying the ink, and a cylinder 130 connected to a compression pump 150 via an air tube.

Referring to the operation of the system 100, when the switch 104 is turned on after the ink cartridge is installed to the cartridge installing device 110, a piston in the cylinder (not shown) applies pressure to the reservoir 120 by the air pressure supplied from the compression pump to thereby supply the ink into the ink cartridge. When the recharge of the ink is completed, the pressure in the cylinder 130 and the reservoir 120 is reduced to supply the ink from the ink tank 140 to the inside of the reservoir 120 to result in the preparation of the next ink injection.

In the system 100 shown in FIG. 1, three tubes 102 for supplying the ink, and three tubes 101 for injecting the ink are provided for supplying a cyan, a magenta, and a yellow color ink, and respective tube is provided with an one-way valve 101*a*, 102*a* for preventing reverse flow of the ink being supplied to the ink cartridge 1 and the reservoir 120. Further, respective storing chamber of the ink tank 140, the cylinder 130, and the reservoir 120 is formed for respective color.

As shown in FIGS. 2 and 3, the cartridge installing device 110 comprises a body 111 in which the ink cartridge 1 is installed, an ink injection portion 112 contacting with the nozzle 2 of the ink cartridge, and a cartridge securing portion 120 located at the opposing side of the nozzle 2. The cartridge securing portion 120 is constructed that a sliding bar 122 moves in the front and rear direction by means of a link 123 when a handle 121 is rotated in the upward and downward direction. An elastic member 124 is installed at the front end of the sliding bar 122 so that excessive force is not applied to the ink cartridge 1 at the time of securing the ink cartridge. An ink injection hole 113 corresponding to the nozzle 2 is provided at the ink injection portion 112 contacting the nozzle 2 of the ink cartridge 1, and the tube 101 for supplying the ink is connected to the ink injection hole 113 via a connector 115. However, although the recharging system for the ink cartridge described above has an advantage that the ink can be recharged with only simple operation of the switch, after installing the ink cartridge to the cartridge installing device, there have occurred several problems described below.

In other words, when the ink is recharged through the nozzle of the ink cartridge using the air pressure as shown in the system 100, if the recharging has been completed, inside pressure of the ink cartridge 1 (pressure produced from the air existed in the ink cartridge and the injected ink) becomes bigger than the atmospheric pressure. Accordingly, if the recharged ink cartridge 1 is to be separated from the cartridge installing device 110 in itself, the ink in the ink cartridge 1 can be gushed to the outside through the nozzle 2, or the ink existed in a space between the nozzle 2 and the ink injection portion 112 can be flowed down to result in the complicated affairs of the ink in the nozzle or the cartridge installing device 110.

The ink cartridge 1 can be divided into a sponge type and a pack type based on the method for storing the ink in the inside of the cartridge. Especially, in case of the pack type, the printing quality can be decreased because the ink can be leaked due to the increase of the inside pressure produced from the remaining air in the cartridge after the completion of the charging of the ink or because excessive amount of the ink is injected through the nozzle at the initial time of printing.

To solve such problem, it is necessary to control the inside pressure of the ink cartridge by discharging a little amount of the ink and the air remaining in the ink cartridge after the completion of the recharging of the ink into the ink cartridge.

However, the ink recharging system 100 described above has a disadvantage that it is not easy to control the inside pressure of the ink cartridge.

Further, it is inconvenient for the ink cartridge recharging system 100 to apply to various types of the ink cartridges having different shapes and volumes. In other words, it is required to adjust the length of the sliding bar 122 every time when the type of the ink cartridge installed to the cartridge installing device 110 has been changed, so that proper securing force cannot be applied to the ink cartridge.

In addition, it is not easy to inject a determined amount of the ink because it is required that movement displacement of the piston in the cylinder 130 should be adjusted by controlling a controller 131 for controlling the amount of the ink supplied so as to inject a determined amount of the ink corresponding to the volume of the ink cartridge installed to the inkjet printer.

Moreover, in the system 100 described above, since only the one-way valve 101*a* has been installed to the tube 101 for injecting the ink, so that the ink cannot flow reversely into the reservoir 120, and a little amount of the ink is remained in the ink injection hole 113 after the completion of the ink recharging work to thereby reduce the quality of the injected ink due to the remained ink in the ink injection hole 113 when the cartridge installing device 110 has not been used for a long time after the completion of the ink recharging work. Also, if such ink is recharged into the ink cartridge as it is, the quality of the printing can be reduced as well as the choking of the nozzle in the ink cartridge can be produced.

SUMMARY OF THE INVENTION

Accordingly, the present invention has been made to solve the above-mentioned problems occurring in the prior art, and an object of the present invention is to provide an ink recharging system for the ink cartridge, which can charge a determined amount of the ink rapidly and accurately by easily discharging the air and ink remaining in the recycled ink cartridge and precisely controlling the vacuum degree in the inside of the ink cartridge with control means for controlling the quantitative ink.

Another object of the present invention is to provide a bulk ink cartridge for using in the above ink recharging system, which can prevent the wrong installment with a simple identifying member.

Still another object of the present invention is to provide an advantageous method for recharging the ink cartridge, in which the ink is recharged by applying the ink cartridge to the recharging system for the ink cartridge described above.

To accomplish the above object and other object of the present invention, there is provided a recharging system for an ink cartridge comprising: an ink cartridge installing device provided with an ink injection portion formed with an ink injection hole communicating with a nozzle of the ink cartridge, and installing the ink cartridge; a quantitative ink supply cylinder connected to the ink injection portion via an ink supply tube; a positive pressure tank for storing high pressure air from a compressor; a charging cylinder connected to the positive pressure tank via a supply tube for the compressed air for supplying the air in the quantitative ink supply cylinder to the ink injection hole through the ink injection tube by using a piston operated by the air pressure supplied from the positive pressure tank; a bulk ink cartridge connected to one side of the quantitative ink supply cylinder for supplying the ink to be charged; a negative pressure tank connected to the ink injection hole of the cartridge installing device via a vacuum tube for maintaining a proper vacuum or sucking remaining ink in the injection portion by a vacuum pump; and quantitative position control means connected to the charging cylinder for controlling the movement displacement of the piston in the charging cylinder.

Also, in the recharging system for the ink cartridge, the ink cartridge installing device further comprises a discharge portion formed separately with a discharge hole communicating with a communicating opening to the atmosphere of the ink cartridge at the opposing side of the ink injection portion, and is connected to the negative pressure tank via the discharge hole and the vacuum tube.

The recharging system for the ink cartridge according to the present invention comprises quantitative position control means installed at the inlet side of the charging cylinder for charging the quantitative ink supplied from the quantitative ink supply cylinder, and concretely, means for controlling the ink to be charged precisely by using the linear type potentiometer converting the displacement of the piston moving reciprocally in the charging cylinder into the potential difference.

Also, the cartridge installing device further comprises a securing member for installing the ink cartridge safely, and securing the nozzle of the ink cartridge, the ink injection hole, the air emitting opening of the ink cartridge, and the discharge hole of the discharge portion, so that they are communicated with each other closely, and in the securing member, the sliding bar with the elastic member forcibly presses the ink cartridge by the handle.

The recharging system for the ink cartridge according to the present invention is provided with a plurality of installing devices for recharging the black ink and the color ink, and the quantitative ink supply cylinder is divided into cylinders for supplying the black ink and cylinders for supplying the color ink, and in case of the quantitative ink supply cylinder for the color ink, plural numbers of the cylinders constitute one set. Also, the shape of the ink injection hole of the cartridge installing device is formed to have a single opening, and the shape of the ink injection hole for the color ink is formed to have a plurality of openings identical with the ink color.

Meanwhile, in the recharging system for the ink cartridge, the reciprocal movement of the piston in the charging cylinder can be controlled by the air pressure supplied alternatively to the inlet side and outlet side of the charging cylinder according to the charging time by the opening and closing operation of the solenoid valve for the air pressure installed at the mid of the supply tube for the compressed air.

Also, the ink supply from the bulk ink cartridge is controlled by the one-way valve or the opening and closing valve, which is repeatedly opened and closed in relation to the operation of the solenoid valve, installed between the bulk ink cartridge and the inlet side of the quantitative ink supply cylinder, and incidentally, the one-way valve or the opening and closing valve, which is repeatedly opened and closed in relation to the operation of the solenoid valve, is installed between the ink injection portion of the ink cartridge and the outlet side of the quantitative ink supply cylinder to thereby be opened at the time of the ink charging and closed at the completion of the ink charging to make the piston in the charging cylinder to move in the inlet side to apply the negative pressure to the quantitative ink supply cylinder.

The positive pressure tank of the present invention is connected to the compressed air supply tube via the assistant positive pressure tank, the negative pressure tank is connected to the vacuum tube via the assistant negative pressure tank, and the assistant positive pressure tank and the assistant negative pressure tank are configured to function as a buffer in the transmission of the pressure and the vacuum degree of the positive pressure tank and the negative pressure tank via the supply tube for the compressed air and the vacuum tube.

Additionally, the ink charging arrangements of the present invention comprises two conductive electrode needles with different heights, which is connected to the bulk ink cartridge for sucking the ink, and is configured to detect whether the ink stored in the bulk ink cartridge has been vanished. The principle is that current cannot be turned on if any one of the electrode needle is lowered below the height of the surface of the ink.

Also, in the present invention, a bulk ink cartridge comprising at least one identifying member formed to be opened in the lower or upper portion thereof, or opened in the mid portion thereof is provided, and the identifying members are installed to the grooves formed at both sides of the ink cartridge in such a combined fashion as to differ in the order to thereby cause a plurality of combined cases.

Further, according to the present invention, there is provided a method for recharging an ink cartridge using the recharging system for an ink cartridge comprising the steps of: installing a used ink cartridge to a cartridge installing device; emitting the remaining ink or air of the ink cartridge by means of the opening and closing operation of the valve installed to a vacuum tube connecting a negative pressure tank with a nozzle of the ink cartridge; supplying a quantitative ink from the bulk ink cartridge to the quantitative ink supply cylinder by supplying the air pressure to an outlet side of a charging cylinder to apply a negative pressure by opening and closing a solenoid valve for the air pressure installed to the supply tube for the compressed air from the positive pressure tank; charging the ink in the quantitative ink supply cylinder into the ink cartridge via the ink supply tube by supplying the air pressure to an inlet side of the charging cylinder through the changed opening and closing operation of the solenoid valve for the air pressure; stopping the supply of the ink to the quantitative ink supply cylinder when the quantitative ink has been supplied by the control means for the quantitative position; and sucking the remaining air or ink in the ink cartridge or in the ink injection hole by the opening and closing operation of the valve installed to the vacuum tube to meet the inside pressure of the ink cartridge supplied of the ink, or to suck the remaining ink in the ink injection hole.

Further, in the recharging method for the ink cartridge according to the present invention, the charging step further comprises the step of facilitating the charging of the ink into the ink cartridge by opening and closing the valve installed to the vacuum tube connected to the air emitting opening of the ink cartridge.

BRIEF DESCRIPTION OF THE DRAWINGS

The above and other objects, features and advantages of the present invention will be more apparent from the following detailed description taken in conjunction with the accompanying drawings, in which:

FIGS. 2 and 3 are side views showing schematically a cartridge installing device shown in FIG. 1, in which FIG. 2 shows a state before the ink cartridge is installed and secured to the cartridge installing device, and FIG. 3 shows a state after it has been installed and secured to the cartridge installing device;

DETAILED DESCRIPTION OF THE PREFERRED EMBODIMENT

Hereinafter, the ink recharging system for the ink cartridge according to the preferred embodiments of the present invention will be described with reference to the accompanying drawings.

Figure 1:
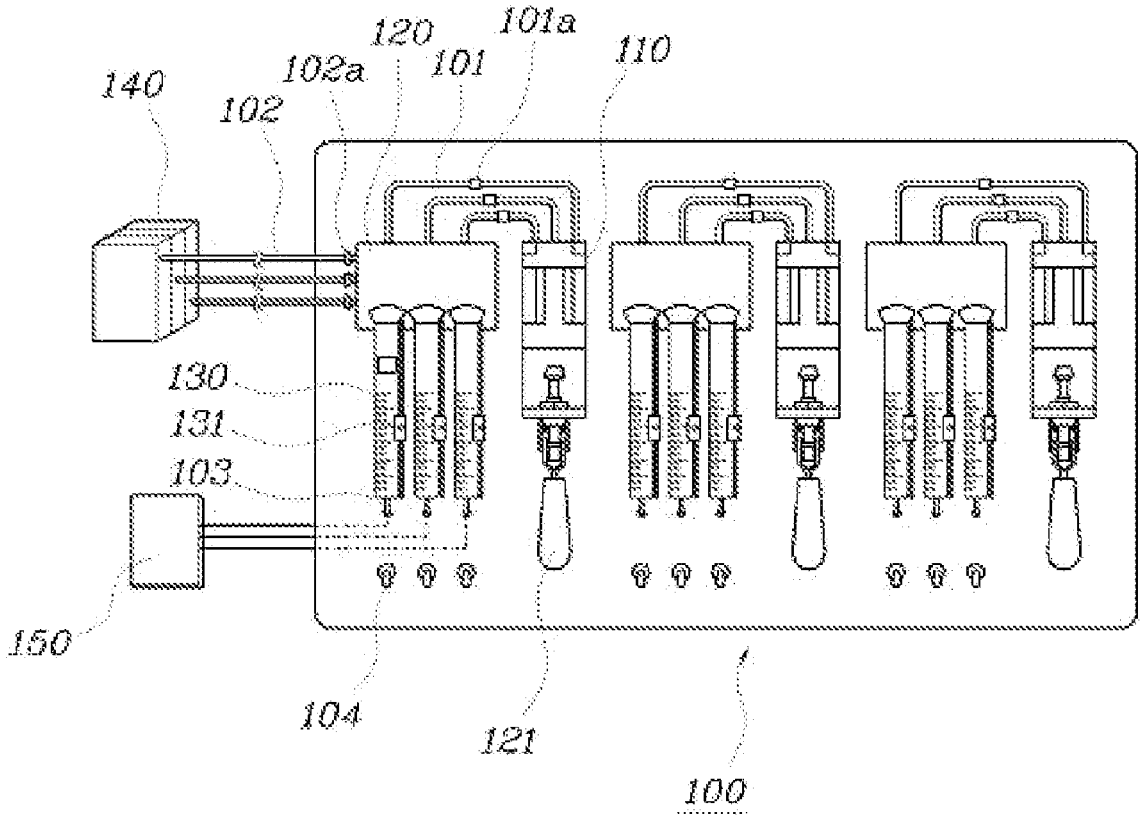
FIG. 1 Prior Art
FIG. 1 is a schematic view showing an ink recharging system for a conventional ink cartridge.
Figure 2:
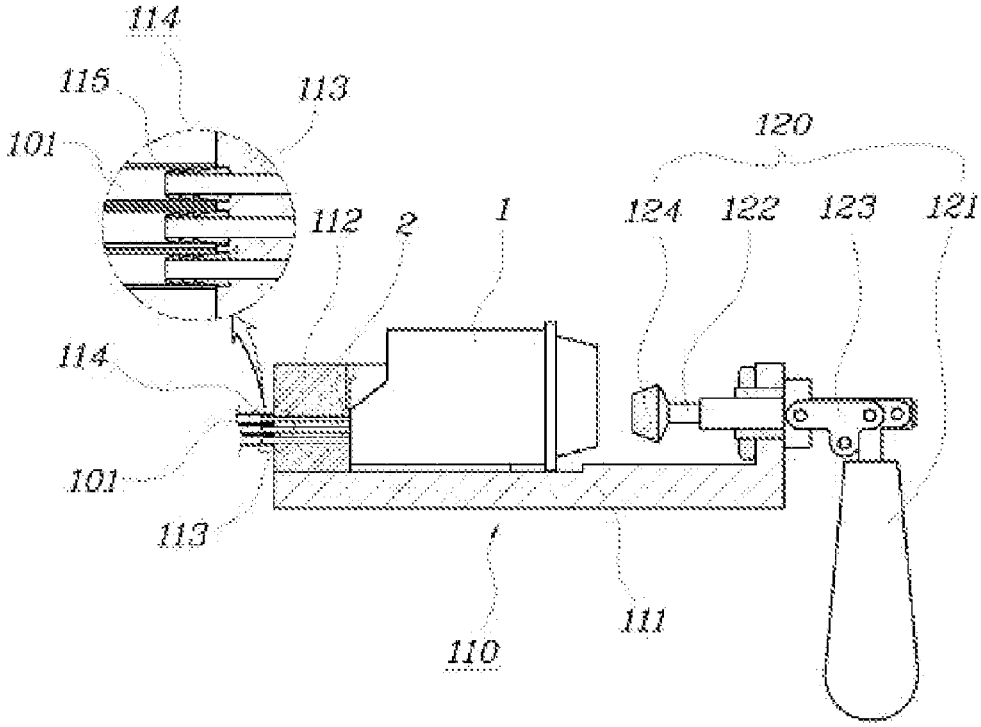
FIG. 2 Prior Art
Figure 3:
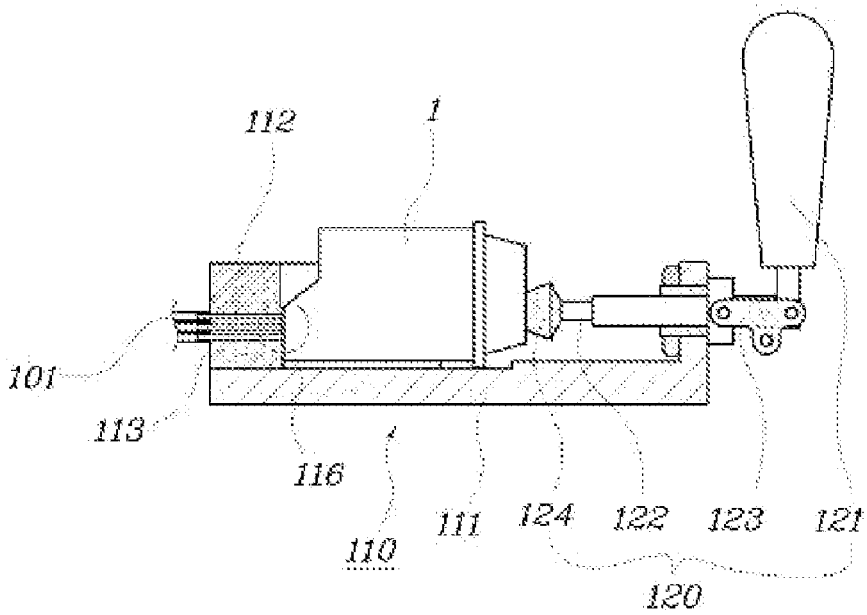
FIG. 3 Prior Art
Figure 4:
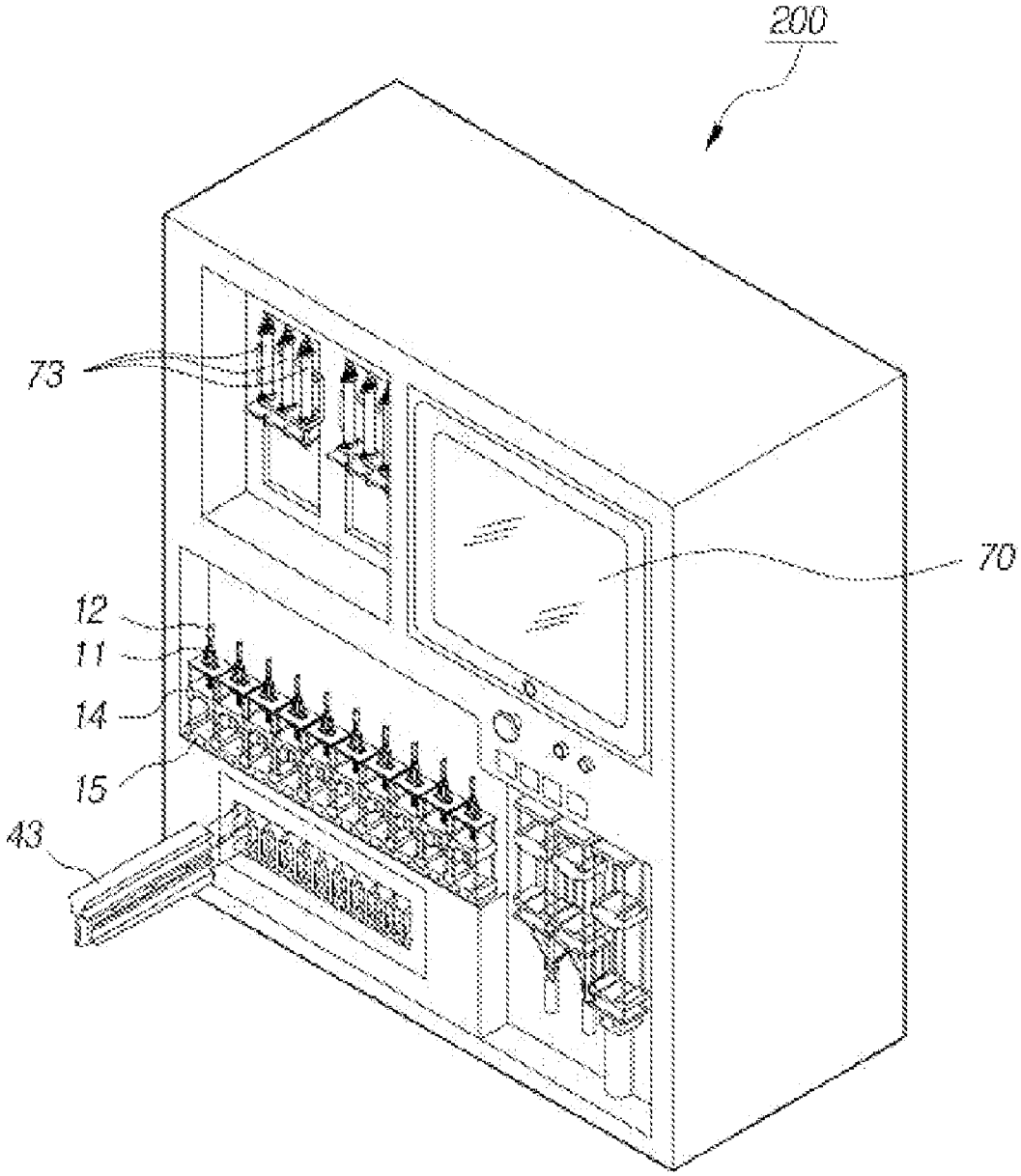
FIG. 4 is a front perspective view showing an ink recharging system for an ink cartridge according to the present invention.

FIG. 4 is a view showing a whole outer appearance of the ink recharging system for the ink cartridge. Referring now to FIG. 4, a touch screen 70 is provided above the upper right side for the operator to confirm the operation condition of the system and to order input. Also, the quantitative ink supply cylinder 73 is provided above the upper left side, and a plurality of cartridge installing devices for the black ink and color ink are installed side by side at the mid portion. Further, a plurality of bulk ink cartridges 43 having a large quantity are installed at the lowest side of the system, in which the black ink or the color ink to be used in the charging work is stored.

Figure 5:
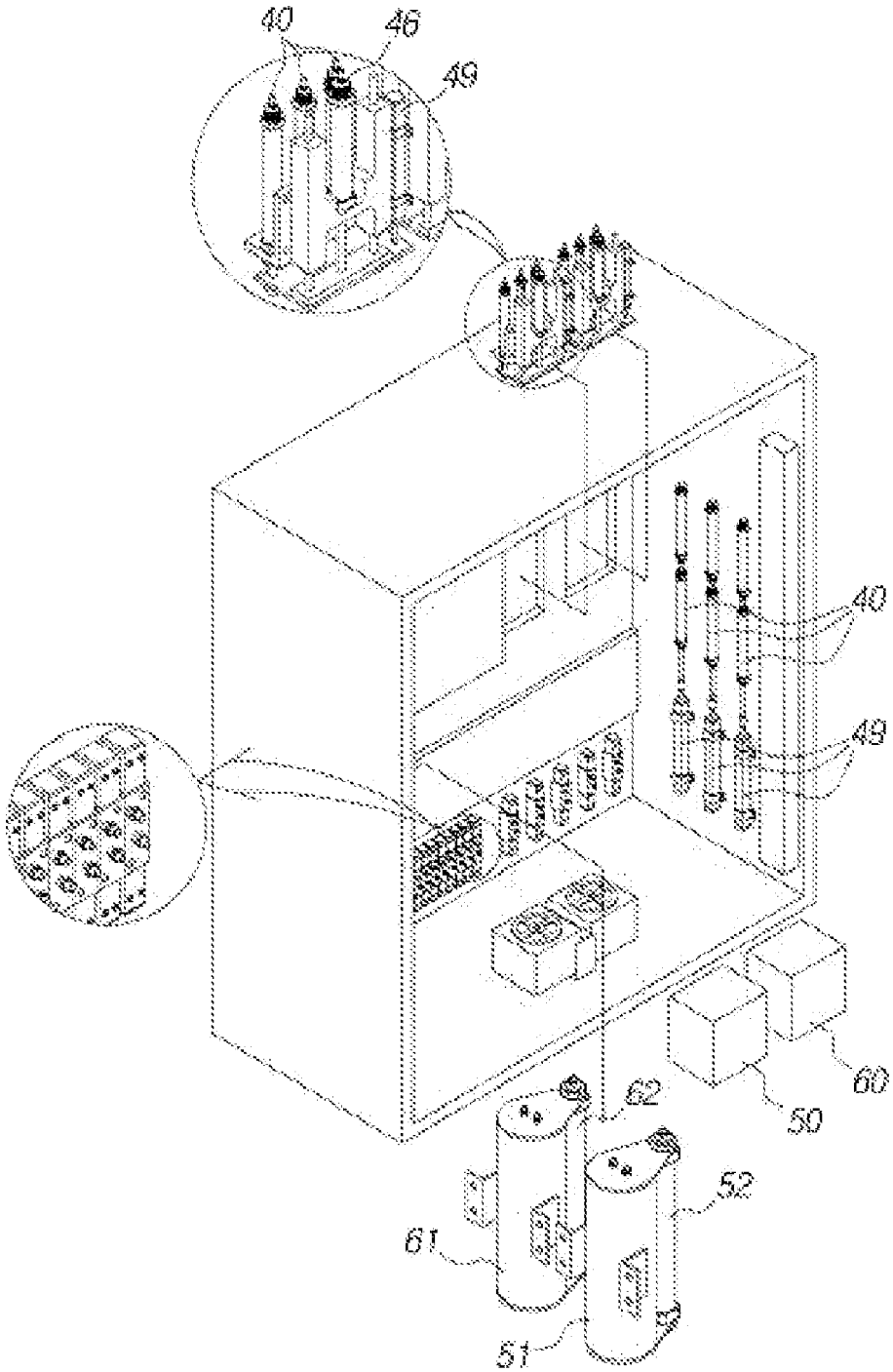
FIG. 5 is a rear perspective view showing an ink recharging system for an ink cartridge according to the present invention.

FIG. 5 is a view showing the inside structure of the ink recharging system for the ink cartridge from the rear side. A positive pressure tank 51, an assistant positive pressure tank 52, a negative pressure tank 61, and an assistant negative pressure tank 62 are provided at the left side, a compressor 50 and a vacuum pump 60 are secured to the lower plate. There are also provided a plurality of potentiometers 49 and charging cylinders 46 employed in a control means for a quantitative position and connected to a supply cylinder (not shown) for the quantitative ink to thereby constitute a part of the ink recharging system.

Figure 6:
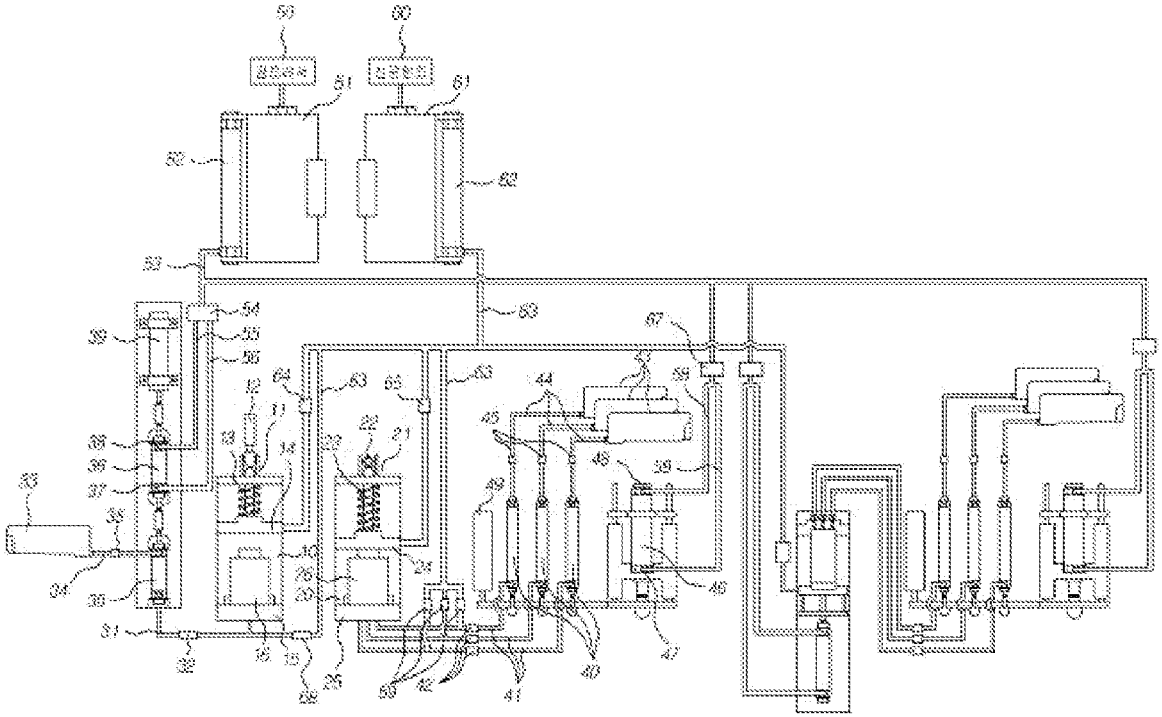
FIG. 6 is a concept view showing a whole mechanism of the ink recharging system for the ink cartridge shown in FIGS. 4 and 5.

FIG. 6 is a concept diagram showing whole structure of the ink recharging system for the ink cartridge according to the present invention.

Hereinafter, the concrete operation of the ink recharging system for the ink cartridge will be described with regard to FIG. 6.

At first, a black ink cartridge 16 is installed by rotating a lever 12 installed at the front end of the securing member 11 after locating the black ink cartridge 16 to the cartridge installing device 10. When the preparation for charging the ink is completed, remaining air or ink in the black ink cartridge 16 is discharged initially through a nozzle by opening a valve 68 for opening and closing the line installed at a vacuum tube 63 based on the instruction from the touch screen 70 to discharge air from the ink cartridge, and the inside pressure of the ink cartridge is controlled by a control portion. When the discharge process has been completed, a solenoid valve 54 for the air pressure is opened according to the input operation of a button instructing the start of the charge work, and the compressed air of the positive pressure tank 51 is supplied to an opening portion 38 of the charging cylinder 36 via a supply tube 55 for the compressed air in the inlet side. When an inside piston (not shown) is moved by the compressed air to apply pressure to the quantitative ink supply cylinder 30, the black ink in the quantitative ink supply cylinder 30 is supplied to an ink injection portion 14 of the cartridge installing device 10 via a supply tube 31 for the black ink, and finally is charged into a nozzle (not shown) of the black ink cartridge 16 communicating closely with an ink injection hole (not shown) via the ink injection hole of the ink injection portion 14. In this instance, the control means 39 for controlling the quantitative position controls the movement displacement of the charging cylinder 36 so that the quantitative black ink can be charged. The control means 39 for controlling the quantitative position can control the amount of the charged ink minutely by using the potentiometer, which is a variable resistance for converting the movement displacement of the piston in the charging cylinder 36 into a potential difference.

Meanwhile, when the ink charge is completed, an one-way valve 32 installed at the black ink supply tube 31 is closed, and incidentally the path for the compressed air supplied via a supply tube 53 for the air pressure is converted into a supply tube 56 for the compressed air in the outlet side by means of the opening and closing operation of the solenoid valve 54 for the air pressure to supply to the outlet portion of the charging cylinder 36, to thereby move the piston (not shown) in the reverse direction. Accordingly, the inside of the quantitative ink supply cylinder 30 is applied of the negative pressure, so that the black ink in the bulk ink cartridge 33 is supplemented to the quantitative ink supply cylinder 30 through the opened one-way valve 35 via the ink supply tube 34. After the ink charge into the black ink cartridge 16 through such ink charging process, a little amount of ink is suctioned via the nozzle of the ink cartridge 16 by opening the valve 64 installed to the vacuum tube 63 to control the inside pressure of the ink cartridge 16 and to charge ink into the nozzle to thereby complete the ink charge. The ink charging process is completed through the process of making the condition for printing after the installment of the cartridge to the printer, and such sequential processes are repeated for another ink charging process.

FIG. 6 shows a constitution of the recharging system for charging concurrently a Cyan, a Magenta, and a Yellow, which are color inks, into the ink cartridges for the color ink.

Hereinafter, the concrete operation of the recharging system for the color ink will be described below.

At first, the color ink cartridge 26 is installed to the cartridge installing device 20 and is secured by rotating the lever 22 installed at the front end of the securing member 21 in the forward direction.

When the preparation of the ink charge has been completed, the remaining air and ink in the color ink cartridge 26 is emitted through the nozzle by the opening of the valve 69 installed at the mid of the tube and connected to the color ink supply tube 41 after diverged form the vacuum tube 63 based on the instruction from the touch screen 70 to discharge the air in the ink cartridge. The inside pressure of the ink cartridge 26 is controlled by the control portion. After the completion of the discharge process, when the compressed air in the positive pressure tank 51 is supplied to the inlet portion 48 of the charge cylinder 46 via the supply tube 58 for the compressed air in the inlet side by the opening of the solenoid valve 67 for the air pressure according to the input instruction of starting the charge work from the touch screen 70, the three color ink stored respectively in the quantitative ink supply cylinder 40 is supplied to the color ink injection portion 25 of the cartridge installing device 20 via the supply tube 41 for the color ink by the movement of the inside piston to thereby be supplied to the nozzle 28 of the color ink cartridge 26 communicating with the color ink injection hole 27 via the color ink injection hole 27 of the color ink injection portion 20 divided by the color. In this instance, the control means 49 for the quantitative position can control the amount of color ink to be charged minutely by using the potentiometer, which is one of the variable resistance converting the movement displacement of the charge cylinder 46 into the potential difference. Meanwhile, when the charging of the color ink has been completed, the one-way valve 42 installed at the supply tube 41 for the color ink is closed, and concurrently the path for the compressed air which is supplied via the supply tube 53 for the air pressure from the positive pressure tank 51, is converted by the opening and closing action of the solenoid valve 67 for the air pressure, and is supplied to outlet portion of the charge cylinder 46 via the outlet side supply tube 59 for the compressed air to thereby move the piston (not shown) in the cylinder to the reverse direction. Then, a negative pressure is applied to the inside of the quantitative ink supply cylinder 40 so that the color ink in the bulk ink cartridge 43 is supplemented to the quantitative ink supply cylinder 40 via the one-way valve 45 through the supply tube 44 for the color ink. After charging the color ink into the color ink cartridge 26 through the color ink charging process, the valve 65 installed to the vacuum tube 63 is opened to suck a little amount of the ink via the nozzle of the ink cartridge 26 to adjust the inside pressure of the ink cartridge 26 and fill the nozzle, resulting in the completion of the ink charge. In this instance, it is possible to install the recharged cartridge to the printer and practice the printing work. Such a sequential process will be repeated for another ink charging work.

Meanwhile, the assistant positive pressure tank 52 is installed at the front of the compressor 50, and a sensor (not shown) is installed at the pressure tank 52 to detect the inside pressure of the assistant tank 52. The assistant positive pressure tank 52 functions to temporarily store the compressed air from the compressor 50 and supply the compressed air of a proper pressure to the charging cylinder 46.

According to the type of the cartridge, some cartridge is provided with a communicating opening to the atmosphere at the upper side thereof. In such a case, a communicating opening to the atmosphere of the ink cartridge and a discharge hole 29 formed at a discharge portion 14, 24 of the cartridge installing device 10 is connected with each other closely during the charging process of the ink, and the charging of the ink into the ink cartridge can be facilitated by producing a vacuum in the ink cartridge through the vacuum tube 63 by operating the vacuum pump 60.

Figure 7:
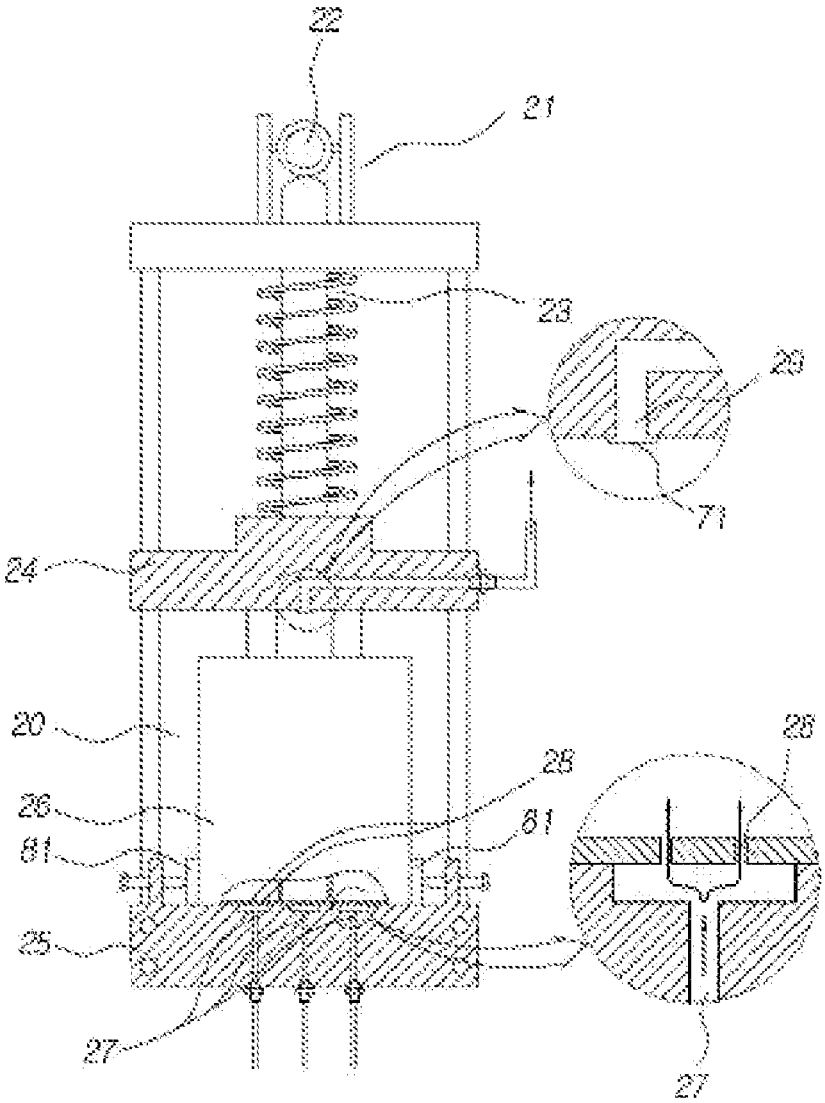
FIG. 7 is a view for illustrating the discharging of the air and the charging of the ink for a color ink cartridge at the state of being installed to the cartridge installing device.

FIG. 7 shows a structure of the cartridge installing device 20, the cartridge securing member 21, and the color ink cartridge 26 installed and secured to the cartridge installing device 20. The cartridge securing member 21 comprises a handle 22, a sliding bar 23, and a discharge portion 24, the ink cartridge 26 is adhered and fixed closely to the cartridge installing device 20 by rotating the handle 22 by ninety degrees to communicate the nozzle 28 of the color ink cartridge 26 with the color ink injection hole 27 of the injection portion 25 sealingly.

According to the kinds of the ink cartridges, a communicating opening to the atmosphere can be provided at the upper side of the cartridge. In such a case, the atmospheric communicating opening 71 is communicated with the discharge hole 29 of the discharge portion 24 with maintaining the close sealing relation.

As described above, remaining air or ink in the color ink cartridge 26 is emitted through the nozzle 28 of the ink cartridge 26 by the suction force of the negative pressure tank 61 maintaining the vacuum by the operation of the vacuum pump before the charge of the color ink, and at the time of charging the color ink, the Cyan, the Magenta, and the Yellow colored ink stored in the quantitative ink supply cylinder 40 is respectively charged into the color ink cartridge 26 through the corresponding nozzle 28 of the color ink cartridge 26 via the lower ink injection hole 27 by the air pressure of the charging cylinder 46.

In the conventional art, it was constructed that an elastic member 124 of rubber material was installed to the front end of the sliding bar 122, whereas, in the present invention, the securing pressure of the ink cartridge is adjusted properly by using a spring of the sliding bar 23, to make it possible to use it permanently in comparison with the elastic member 124 made of rubber material and to apply determined pressure in spite of the continuous use of it.

The cartridge installing device 20 can be further provided with a side guide member 81 for adapting to the depth and width of the cartridge installed freely regardless of the size and shape of the color ink cartridge 26 installed, which is different from the conventional art. Also, in the present invention, it is possible to supply ink into the whole product of all the manufacturing company for the color ink cartridge by variously installing the detachable ink injection portion 25 with an the ink injection hole 27 coinciding with the standards of the shape and size of the cartridge nozzle, and it is also possible to replace and install the ink injection portion 25 with the ink injection hole 27 of a particular standards, if desired.

Figure 8:
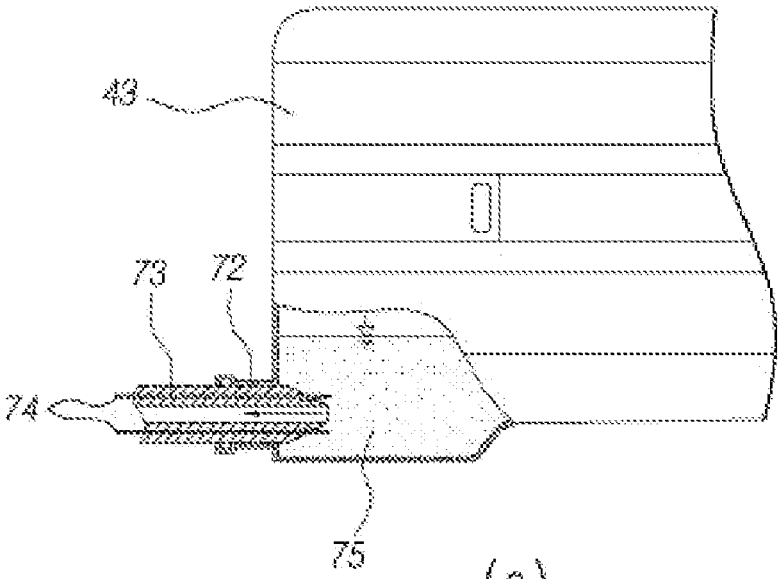
FIGS. 8(*a*), 8(*b*) are views for illustrating an installment structure of an electrode for detecting whether the ink in the bulk ink cartridge has been vanished.
Figure 8:
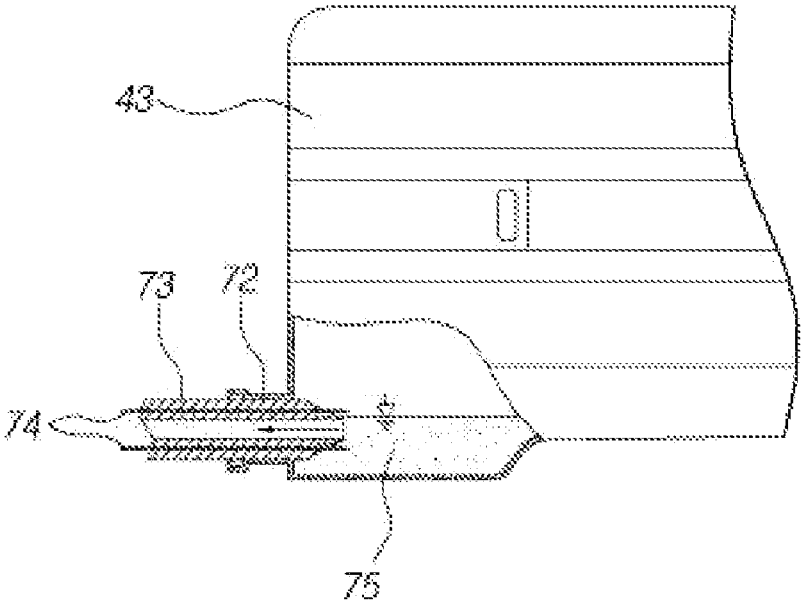

FIGS. 8(*a*), 8(*b*) are views showing the constitution of judge whether the bulk ink cartridge 43 has any remaining amount of ink and ink supply. The bulk ink cartridge 43 is installed detachably to a separate mounting device so that it can be replaced with a new bulk ink cartridge when the ink stored in it has been vanished completely, and a sensor is installed for detecting whether it is installed to the cartridge installing device, and the information sent from the sensor is transmitted to the control portion (not shown). An ink supply tube 73 is inserted forcibly and secured into a round pipe-shaped projecting portion 72 at the lower one side in order to detect whether the ink in the bulk ink cartridge 43 has been vanished, and a plurality of electrode needles 74 of different heights are inserted into the upper and lower inside of the ink supply tube 73, the end thereof is immersed into the ink. The electrode needle 74 utilizes the conductivity of the ink charged into the ink cartridge. The electrode needle 74 maintains the turn on state by means of the ink when the ink is filled to the full, however, when the height of the surface of the ink is positioned between the upper and lower electrode needles 74 due to the vanish of the ink, it is impossible to maintain the turn on state between the electrode needles via the ink, so that it is possible to confirm easily whether the ink in the bulk ink cartridge has been vanished by observing the blinking of an LED (not shown) based on the turn on signals.

According to the ink recharging system for the ink cartridge according to the present invention shown in FIGS. 4 to 7, the nozzle side of the ink cartridge is arranged in the downward direction, however, it can be changed into another structure in which it is arranged in the reverse direction according to the lathe design.

Figure 9:
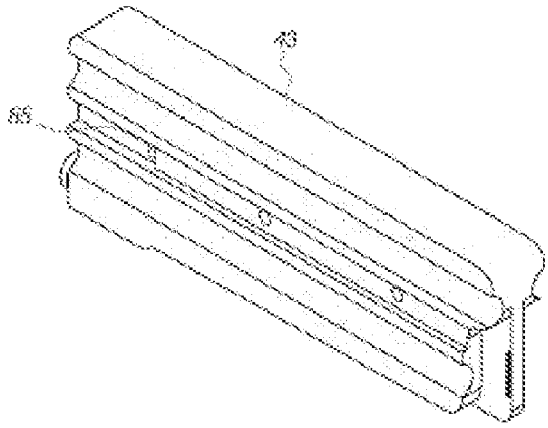
FIG. 9 is a view showing the bulk ink cartridge including the identifying member inserted into both sides of the bulk ink cartridge according to the present invention.
Figure 9:
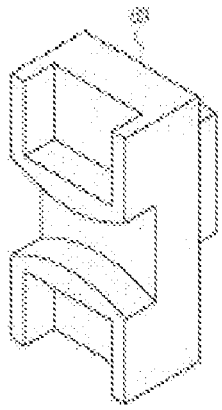
Figure 9:
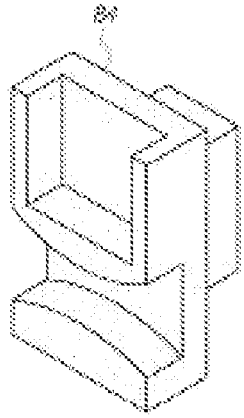
Figure 9:
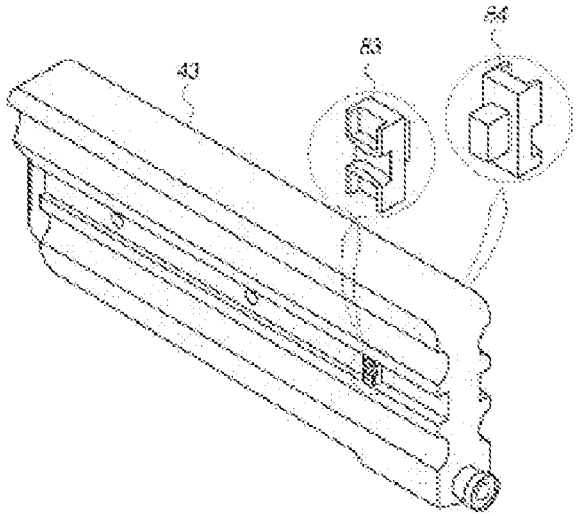

FIG. 9 is a view showing a bulk ink cartridge which can prevent the wrong installment by installing a separate identifying member at the grooves formed at both sides of the bulk ink cartridge.

The kinds of the bulk ink cartridge are decided to be plural based on the kinds of the color and the kinds of the cartridge to be charged. The bulk ink cartridge can be wrongly charged by different kind of ink, when it has been installed to a position different from the right position as it has similar shape. In the present invention, in order to prevent such problems, the bulk ink cartridge is provided with grooves at both sides, and two kinds of identifying member are respectively installed into the grooves to make it possible to identify the whole nine kinds of the bulk ink cartridges.

Such cases can be classified as following cases: the identifying members 83, 84 shown in FIG. 9(*b*) are inserted at right position into the grooves 85 at right and left sides of the bulk ink cartridge shown in FIG. 9(*a*), the identifying member 83 is inserted into the left side groove of the bulk ink cartridge in the right position and is also inserted into the right side groove of the bulk ink cartridge in the reverse position, the identifying member 83 is inserted into the right side groove of the bulk ink cartridge in the right position and is also inserted into the left side groove of the bulk ink cartridge in the reverse position, and the identifying members 83 are inserted into the whole grooves in the right/left sides of the bulk ink cartridge in the reverse position. Further cases are listed as following cases: the identifying member 83 can be inserted into the left side groove of the bulk ink cartridge in the right position and the identifying member 84 can be inserted into the right side groove, also the identifying member 83 can be inserted into the left side groove in the reverse position and the identifying member 84 can be inserted into the right side groove, the identifying member 84 can be inserted into the left side groove of the bulk ink cartridge and the identifying member 83 can be inserted into the right side groove in the right position, the identifying member 84 can be inserted into the left side groove of the bulk ink cartridge and the identifying member 83 can be inserted into the right side groove in the reverse position. Finally, the identifying members 84 can be inserted into all of the right/left side grooves of the bulk ink cartridge. As described above, the bulk ink cartridges can be identified by the above described nine kinds based on the combination of the identifying members, the inserted grooves and the position.

FIG. 9(*c*) shows the form of the bulk ink cartridge into which the identifying members 83 or 84 are inserted. In the present invention, an ink charging arrangements 200 is provided at an installing portion for the bulk ink cartridge with projecting portions corresponding respectively to the above identifying members to thereby prevent the wrong installment of the bulk ink cartridge by the operators.

According to the recharging system for the ink cartridge as constructed above, remaining air and remaining ink are emitted through the nozzle of the ink cartridge before the charging work, and vacuum is applied through the air discharge opening formed separately at the surface opposing to the nozzle of the ink cartridge during the charging process of the ink cartridge to make it possible to adjust the velocity of the ink charging work, and it is possible to proceed the charging work of the ink into the ink cartridge very smoothly through the minute adjustment of the pressure by using the nozzle so that there is no remained bubble in the nozzle.

Further, it is possible to control the amount of the ink to be charged minutely to the fine range by converting the fine movement displacement of the piston in the charging cylinder into the change amount of the potential difference by using the potentiometer.

Also, it is possible to control the inside pressure of the ink cartridge by extracting a little amount of the air and ink in the recharged ink cartridge at the time of the completion of the ink charge, and also it is possible to extract the waste ink remained in the ink cartridge at the initial time of the recharging of the ink, if necessary.

In addition, the ink charging work of the present invention can be carried out by simple operation of the button in the touch screen provided at one side of the system, and the operator can observe and manage the whole process of the ink recharging work through the touch screen.

Although preferred embodiments of the present invention have been described for illustrative purposes, those skilled in the art will appreciate that various modifications, additions and substitutions are possible without departing from the scope and spirit of the invention as disclosed in the accompanying claims, and they fall in the scope of the present invention disclosed in the appended claims.

What is claimed is:

1. A recharging system for an ink cartridge comprising:

an ink cartridge installing device provided with an ink injection portion formed with an ink injection hole communicating with a nozzle of the ink cartridge, and installing the ink cartridge;

a quantitative ink supply cylinder connected to the ink injection portion via an ink supply tube;

a positive pressure tank for storing high pressure air from a compressor; a charging cylinder connected to the positive pressure tank via a supply tube for the compressed air for supplying the air in the quantitative ink supply cylinder to the ink injection hole through the ink injection tube by using a piston operated by the air pressure supplied from the positive pressure tank;

a bulk ink cartridge connected to one side of the quantitative ink supply cylinder for supplying the ink to be charged;

a negative pressure tank connected to the ink injection hole of the cartridge installing device via a vacuum tube for maintaining a proper vacuum by a vacuum pump; and quantitative position control means connected to the charging cylinder for controlling the movement displacement of the piston in the charging cylinder.

2. The recharging system for the ink cartridge according to claim 1, wherein the ink cartridge installing device further comprises a discharge portion formed separately with a discharge hole communicating with an air emitting opening of the ink cartridge at the opposing side of the ink injection portion.

3. The recharging system for the ink cartridge according to claim 1, wherein the quantitative position control means comprises a linear type potentiometer.

4. The recharging system for the ink cartridge according to claim 1, wherein the cartridge installing device flirt her comprises a securing member for installing the ink cartridge safely, and securing the nozzle of the ink cartridge, the ink injection hole, the air emitting opening of the ink cartridge, and the discharge hole of the discharge portion, so that they are communicated with each other closely.

5. The recharging system for the ink cartridge according to claim 4, wherein the securing member comprises a handle, a sliding bar, and a spring.

6. The recharging system for the ink cartridge according to claim 1, wherein the cartridge installing device further comprises a side guide member, which can move freely along its width and depth so that the cartridge can be secured safely in correspondence with the various standards of the ink cartridge, at the lower portion of the cartridge installing device.

7. The recharging system for the ink cartridge according to claim 1, wherein the quantitative ink supply cylinder is provided to be plural number for the single black ink, and the ink injection hole of the ink injection portion is formed to have a single opening.

8. The recharging system for the ink cartridge according to claim 7, wherein the ink injection hole of the ink injection portion is formed to have a single opening for the black ink.

9. The recharging system for the ink cartridge according to claim 8, comprising a plurality of ink injection portion for the black ink as well as for the color ink.

10. The recharging system for the ink cartridge according to claim 1, wherein the quantitative ink supply cylinder is provided to be plural sets for the color ink, and the ink injection hole of the ink injection portion is formed to have a plurality of openings identical with the number of the ink color.

11. The recharging system for the ink cartridge according to claim 10, wherein the ink injection hole of the ink injection portion is formed to have a plurality of openings for the color ink.

12. The recharging system for the ink cartridge according to claim 1, wherein the compressed air supply tube is provided with a solenoid valve for the air pressure for controlling the alternative supply of the air pressure to the inlet side and the outlet side of the charging cylinder by being opened and closed, based on the time of the charge of the ink.

13. The recharging system for the ink cartridge according to claim 1, wherein two conductive electrode needles with different heights are provided to detect whether the ink stored in the bulk ink cartridge has been vanished.

14. The recharging system for the ink cartridge according to claim 1, wherein the positive pressure tank is connected to the supply tube for the compressed air via an assistant positive pressure tank.

15. The recharging system for the ink cartridge according to claim 1, wherein the negative pressure tank is connected to a vacuum tube via an assistant negative pressure tank.

16. The recharging system for the ink cartridge according to claim 1, wherein the bulk ink cartridge comprises at least one identifying member installed to the inserting grooves formed at both sides thereof.

17. The recharging system for the ink cartridge according to claim 16, wherein the identifying member is formed to be opened in the lower or upper portion thereof, or opened in the mid portion thereof.

18. The recharging system for the ink cartridge according to claim 17, wherein the identifying member includes two or more identifying members, which are installed to the grooves formed at both sides of the ink cartridge in such a combined fashion as to differ in the order to thereby cause a plurality of combined cases.

19. The recharging system for the ink cartridge according to claim 11, comprising a plurality of ink injection portion for the black ink as well as for the color ink.

20. A method for recharging an ink cartridge using the recharging system for an ink cartridge comprising the steps of:

installing a used ink cartridge to a cartridge installing device;

emitting the remaining ink or air of the ink cartridge by means of the opening and closing operation of the valve installed to a vacuum tube connecting a negative pressure tank with a nozzle of the ink cartridge;

supplying a quantitative ink from a bulk ink cartridge to a quantitative ink supply cylinder by supplying the air pressure to an outlet side of a charging cylinder to apply a negative pressure by opening and closing a solenoid valve for air pressure installed to the supply tube for the compressed air from a positive pressure tank;

charging the ink in the quantitative ink supply cylinder into the ink cartridge via the ink supply tube by supplying the air pressure to an inlet side of the charging cylinder through the changed opening and closing operation of the solenoid valve for air pressure;

stopping the supply of the ink to the quantitative ink supply cylinder when the quantitative ink has been supplied by the control means for a quantitative position; and sucking the remaining air or ink in the ink cartridge or in the ink injection hole by the opening and closing operation of the valve installed to the vacuum tube.

21. The recharging method for the ink cartridge according to claim 20, wherein the charging further comprises facilitating the charging of the ink into the ink cartridge by opening and closing the valve installed to the vacuum tube connected to the air emitting opening of the ink cartridge.

* * * * *